US005265765A

United States Patent [19]

Maier

[11] Patent Number: 5,265,765

[45] Date of Patent: Nov. 30, 1993

[54] CONTAINER MADE OF FLEXIBLE PLASTIC FOR ATTACHING TO AN INFLEXIBLE TOP AND METHOD FOR ATTACHING SAME

[75] Inventor: Hans E. Maier, Gelsenkirchen, Fed. Rep. of Germany

[73] Assignees: Hildegard Hirsch geb. Bauerle, Giengen/Brenz; Rolf Hirsch, Weilimdorf, both of Fed. Rep. of Germany

[21] Appl. No.: 834,538

[22] Filed: Feb. 7, 1992

[51] Int. Cl.[5] ..... B65D 35/56

[52] U.S. Cl. ..... 222/105; 222/386.5; 222/402.1

[58] Field of Search ..... 222/92, 105, 386.5, 222/402.1

[56] References Cited

U.S. PATENT DOCUMENTS

| | | | |
|---|---|---|---|
| 3,606,089 | 9/1971 | Chambers | 222/95 |
| 3,961,725 | 6/1976 | Clark | 222/386.5 X |
| 4,222,499 | 9/1980 | Lee et al. | 222/386.5 X |
| 4,383,399 | 5/1983 | Stoody | 222/386.5 X |
| 4,964,540 | 10/1990 | Katz | 222/105 X |

*Primary Examiner*—Andres Kashnikow

*Assistant Examiner*—Joseph A. Kaufman

*Attorney, Agent, or Firm*—Herbert Dubno

[57] ABSTRACT

The invention pertains to a liner made of elastic, deformable, flexible material. By the special design of the contours in the area of its opening, shoulder, sides, and its bottom, the liner is intended to be so firmly attached to a top, that the assembled components can be handled, stored, and transported as a single unit. The liner, by its quality and form is, by vacuum, completely contracted in the moment of its pneumatic attachment and will be fixed at the top and oriented to its intended resulting shape and direction. Such a liner is used in connection with the manufacturing of a valve liner unit which is intended to be used in a pressurized container. With this valve liner unit, it is possible to easily manufacture a pressurized container by a method according to which the container is first pre-pressurized with compressed air or other compressed gases, while the filling goods make no contact with the inner walls of the container and whereby it is not necessary to create an additional opening to the container instead of the one opening for inserting the valve liner unit. The filling goods can be introduced into the pre-pressurized container according to this method without contact with environmental air.

6 Claims, 2 Drawing Sheets

CONTAINER MADE OF FLEXIBLE PLASTIC FOR ATTACHING TO AN INFLEXIBLE TOP AND METHOD FOR ATTACHING SAME

FIELD OF THE INVENTION

The invention concerns a container made of flexible plastic for fastening to an inflexible top and a method for fastening the flexible container to an inflexible top. Furthermore, the invention concerns a method for filling pressurized vessels, which consist of a pressurized container which contains a propellant, and at least one flexible liner in it, which serves for the acceptance of filling goods, while the the interior of the flexible liner is closed by means of a valve, which is positioned in the area of the opening of the pressurized container, and finally, the pressurized vessel and the unit as a combination of valve and liner.

THE RELATED ART

There are known pressurized vessels which commonly are called aerosol containers, in which the filling goods and the propellant are intermixed or dissolved and/or dispersed in each other. By actuating the valve, the filling goods exit together with the propellant.

Furthermore, it is known to design the pressurized vessel in so-called two chamber spray systems, in order to prevent the filling goods coming in contact with the pressurized container and/or with the propellant. So it is possible to fill aggressive and pasty filling goods in metal containers, for example, in tinplate cans and release these goods in the form of a spray, foam, or sqeezed paste without intermixing with the propellant.

In two compartment spray systems, metal or glass vessels are used as outer containers, as they have been used for several decades as aerosol containers for filling of material such as body care products, hair care products, insecticides, impregnating sprays, technical aerosols, etc. The liners which serve for the acceptance of the product which has to be released, are bags made of flexible material like, for example, thermoplastic synthetic material or aluminium. The bag, which is surrounded by the pressure of the propellant, is compressed if the pressure is released, and therefore the product is transported out of the opening of the valve of the pressurized container in the form of a spray, or squeezed paste after actuating the valve.

As a propellant all types of compressed gases such as, preferable, environmentally safe compressed air, and other gases under pressure can be used.

All these known two compartment spray systems have in common that, on the bottom or any other location of the pressure resistant vessel, there is a small opening. The flexible liner is held in the container by being pinched at the welt of its opening during the crimping process. In order to obtain clearance for the wall thickness of the liner, the opening of the aerosol containers must be enlarged wider than the normal standard opening diameter. It is necessary to forcefully insert the liner, which has a comparatively wider diameter under temporary deformation, into the unpressurized container through its comparatively narrow opening. By this operation, damage to the liner can occur as a consequence of which an unintended mixture of filling goods and propellant can result.

The filling process is done in this way that, firstly, the product is filled into the empty liner, which previously had been inserted into the unpressurized container, with the result that the liner is returned to its original size after being filled with the filling goods.

In an additional separate operation, the valve is positioned and is securely combined with the edge of its mounting cup together with the brim of the opening of the liner by crimping to the container.

The filling of the known two chamber system with propellant requires a costly technology, because at the bottom of the vessel or at another location in the area of the valve of the container an opening must be made. By means of special equipment, the propellant is inserted through this opening. After this, the opening is to be closed by an elastic bung. Then, the actuator or spout for expelling pasty goods respectively, is to be mounted upon the valve. By pressing the actuator, the filling goods are brought out of the pressurized container under the pressure of the propellant which affects the inner liner.

With concern that fluorochloro-hydroxycarbon propellants, which until recently were commonly used in aerosol containers, are harmful to the earth's ozone, there is an increasing interest to substitute these propellants by less dangerous condensible gases or even abandon all types of hydrocarbons propellants. The two compartment spray systems, in which compressed air is the pressurizing medium, and therefore a propellant has proved to be a good alternative. However, this system involves several disadvantages. The elastic bung, which is inserted in the bottom hole, can cause a loss of pressure during extended periods of storage. Apparently the problem arises from inadequate sealing due to the irregular shape of the hole and/or the deterioration of the bung material, through which functioning of the vessel is partially or completely impaired. The enlarging of the opening of the vessel and the creation of the bottom hole is performed in a more or less controlled way, so that irregular deformation cannot be avoided during the enlarging of the opening diameter and perforation of the bottom. In addition, containers which are modified in this way are not in keeping with the original design approved by the authorities. Furthermore, the process of filling these containers is time consuming, complicated, and expensive. Especially in combination with pasty filling goods, the unintended inclusion of air bubbles is unavoidable. Air bubbles enclosed in pasty goods are rather undesirable because after expelling of the filling goods, they spontaneously expand causing a splattering of the squeezed goods.

Conventional methods of sealing are especially complicated because it is necessary to provide secure closure of the additional above mentioned hole in the container, because the container was originally crimped without inner pressure and then later pressurized in the space between the liner and the wall of the container.

By way of this hole the desired pressure is generated by a pressurizing agent like compressed air or other gases.

By retaining the pressure in the interior of the container, the hole finally, as described above, must be plugged securely.

The resistance of this type of closure, as experience shows, does not always guarantee proper function of the known two chamber system as described above.

The present invention, based upon the general knowledge of aerosol technique, provides a method which avoids the disadvantages stated above and improves the nature of aerosol containers to such an extent that there can be used not only various types of propellants, especially pressurized air, but also the normal standard aerosol containers in that the whole process of filling can be accomplished in a comparatively short time and thus with little expense. The invention provides a liner made of elastically deformable, flexible material which is to be fastened to an inflexible top so firmly that the combined parts can be handled, stored, and transported as a unit.

SUMMARY OF THE INVENTION

According to the invention, a container empty of product is formed from a flexible plastic material for attachment to an inflexible surface. The container comprises:

a liner with cylindrical walls having an open end and a closed end;

a cylindrical neck having a first and second end opposite one another, the first end being connected to the open end;

a cup-like upper area with walls of major diameter greater than the neck having an open mouth and an open rear end juxtaposed opposite each other, the rear end being directly connected to the second end of the neck; and wherein the cup-like upper area is arranged to receive a valve housing formed with the inflexible surface, and the walls of the cup-like upper area are positioned to solidly attach to the inflexible surface and the neck is positioned to be capable of supportingly contacting a cylindrical contour of the valve housing upon evacuation of air from the container.

As a result of the special contours in the area of the opening of the liner, which is conforming to the those of the inflexible top, the liner will be fixed to the inflexible top by the process of evacuation which is a pneumatic process of attachment, while the container is folded inwardly. The attachment is immobilized by conforming as nearly as possible with the opening of the area of the elastic, flexible liner to the contour of the inflexible top, to which it is to be attached by suction.

The liner is positioned with respect to vertical alignment relative to the inflexible top. Furthermore, by the presence of the neck it is guaranteed that the area of the opening of the liner during the brief moment of evacuation is precisely secured in relation to the inflexible top. Without the possibility of the liner supported by the valve housing during evacuation, the liner would lose contact with the top in the area of the opening and thereby lose its seal.

In a further aspect of the invention, the liner walls of the container are provided with vertical, lengthwise formations that can either be inwardly directed grooves, outwardly directed bulges or combinations of such formations. The liner will be compressed at the moment of pneumatic attachment due to its physical properties and shape. Moreover, the liner will be fixed at the top and oriented to its intended resulting shape and direction.

A further aspect of the invention is a valve unit for insertion into the container and to operate the assembled aerosol dispenser. The valve unit comprises:

a mounting cup formed of walls with upper and lower surfaces, the walls being raised to project upwardly in a central bottom area of the cup thereby forming on the lower surface a hollow well;

a valve housing inserted within the hollow well;

a valve seat positioned within the housing; and wherein the lower surface of the mounting cup is attachable to and shaped for secure sealing contact with form fitting portions of a flexible plastic container upon opening the valve seat and evacuating air from the container, the portions including a cup-like area. In this arrangement the aforementioned top is the mounting cup of a female valve being used together with aerosol containers. The flexible plastic liner at first is slightly pressed to the underside of the edge of the mounting cup of the valve. By pressing down the seat of the valve with a hollow needle against the resistance of the spring, there is established an open connection between the environment and the interior of the elastic liner, the latter being slightly pressed at the top involved. Through this connection the air contained in the liner is evacuated. The assembly of the valve and liner can be considered as one unit. Like known aerosol valve assemblies consisting of a valve and dip-tube which is inserted or mounted at the valve housing, the valve and liner assembly according to the invention and consisting of valve and pneumatically attached liner, can be pre-assembled, stored, or transported and manually or automatically inserted into the opening of an empty, aerosol container and can be permanently combined with it by crimping. Due to its now compressed and essentially reduced shape concerning volume and diameter, the valve liner unit can easily be inserted manually or pneumatically in the opening of the unpressurized aerosol container and can be later crimped together because of the liner is firmly attached to the mounting cup of the valve.

The valve housing will, advantageously, be of sufficient length to be contacted by the neck of the flexible container upon air being evacuated from the container. The liner can be precisely positioned and oriented in relation to the valve during evacuation as a result of the elongated neck and length in valve housing.

According to the inventor, the liner is designed in its shape and profile by lengthwise bulges and/or grooves in such a way that during the process of pneumatic attachment by vacuum, it is stretched and vertically aligned in a compressed shape. From an end view the liner will assume the appearance of a multi-pointed star, or a compressed and elongated bladder or some other controlled form which can be effected by modifying the tooling. The diameter of the liner is essentially reduced during this process; the liner attached to the valve will, for instance, form a stretched, lengthwise, bar-shaped, star-like object which is vertically aligned in relation to the mounting cup of the valve when three or more grooves are lengthwise formed on the liner.

If there are only two grooves formed on the opposite sides of the liner, the liner, by evacuation, deforms into a lengthwise, extended, slightly bowed, flattened bladder which can be easily rolled into a shaft like form.

The cup-like area of the valve unit, along an upper periphery on an end opposite to an end connected to the neck, can be circumferentially provided with a U-shaped trough-like brim downwardly directed toward the neck.

An especially tight attachment is thereby effected of the brim on the flexible container to the mounting cup of the valve. As a further improvement to achieve tight attachment, the mounting cup may also be provided with a U-shaped trough-like brim. The brim of the mounting cup will be of a larger dimension than and shaped to form-fittingly receive therewithin the cup-like area brim.

According to the invention there is also provided a pressurizable vessel which includes an outer rigid aerosol container in combination with the flexible plastic container and valve unit. Since the valve unit and flexible plastic container, i.e. liner, are designed as a single unit, their assemblies are essentially simplified by the invention.

The invention also provides a method for assembling a valve-container unit. The method comprises:

(i) inserting the valve unit into the cup-like upper area;

(ii) opening the valve seats;

(iii) withdrawing air from the container to cause an upper surface of the walls of the cup-like upper area to attach to the lower surface of the mounting cup thereby securely sealing the attachment. Due to the method for the assembling of the valve and liner unit according to the invention, the compressed liner, after closing of the valve and disconnecting from the atmospheric pressure, is fastened by the effect of the vacuum in the interior of the liner so securly to the top that it cannot be disconnected from the liner except by a force which exceeds the force of the suction. By this aspect of the method, the invention differs from all used methods in relation to all known two chamber systems, principally because the liner is evacuated before the goods are filled and/or the liner is inserted into the container.

According to the aforementioned method it is advantageous to position the valve housing within the neck of the flexible container and to supportingly contact the housing as a result of evacuation of air therefrom. According to this arrangement, the intended orientation of the liner is thereby obtained with respect to the mounting cup of the valve. In addition, the valve housing is secured by means of the neck in such a way that the liner is attached securely to the mounting cup of the valve. Absent this possibility for supporting the liner at the housing of the valve, it could occur comparatively often that the area of the opening of the liner is contracted during evacuation so that the tightening connection of the area of the liner to the underside of the mounting cup of the valve could be lost.

A method is also provided for assembling and filling the pressurizable vessel. The method comprises:

(i) inserting the valve unit into the cup-like upper area;

(ii) opening the valve seat;

(iii) withdrawing air from the container to cause an upper surface of the walls of the cup-like upper area to attach to the lower surface of the mounting cup thereby securely sealing same;

(iv) inserting the evacuated flexible plastic container and valve unit into an open end of the aerosol container;

(v) pressurizing with a gas the aerosol container in an area between the inner surface of the walls defining the aerosol container and an outer surface of the liner walls; and (vi) crimping together the open end of the outer aerosol container with the mounting cup of the valve unit and the cup-like area of the evacuated flexible container.

Due to the increase of the volume of the filled liner, which is positioned inside of the filled, pre-pressurized container, the final pressure in the space between its inner wall and the liner is generated by the expansion of the liner during the filling process. Therefore it is unnecessary to build up pressure subsequent to filling as is done in the case of the other two compartment systems described above. The filling goods can be inserted hermetically, and any contact is prevented between the filling goods and the inner wall of the container.

According to the aforementioned method a further step (vii) may be practiced by filling the liner to the extent that the walls of the liner are expanded to lengthwise contact an inner surface of the aerosol outer container. Damage can thus be prevented to the liner as a result of collision with the aerosol outer container walls during excessive movement or while the article is being handled or transported. Furthermore, the extent of the inside pressure, which is needed for releasing the filling goods, is increased by the expansion of the liner during the filling process.

In a still further advantageous aspect of the invention, the liner can be forcefully inflated by filling with a product. The molecular structure and physical properties, especially permeability, of the flexible plastic material of the liner can be improved through this rapid expansion technique. It was surprisingly detected that a diffusion, which was observed before by using unexpanded liners during the course of storage, did not occur any more. By the rapid expansion during the filling process, the liner is brought in contact with the bottom and/or the walls of the pre-pressurized container, which results in creating an immobile position of the liner inside.

According to the invention the aforementioned method may further include between steps (iv) and (v), the step of lifting up the inserted flexible container and valve unit to provide an opening between the open end of the outer aerosol container and the neck for allowing space to introduce the pressurizing gas. As a result of such step, the pressure, which is needed for releasing the product from the pressurizable vessel, will be additionally increased.

BRIEF DESCRIPTION OF THE DRAWING

The invention is described in a more detailed way by means of the following drawings wherein.

DETAILED DESCRIPTION

Figure 1:
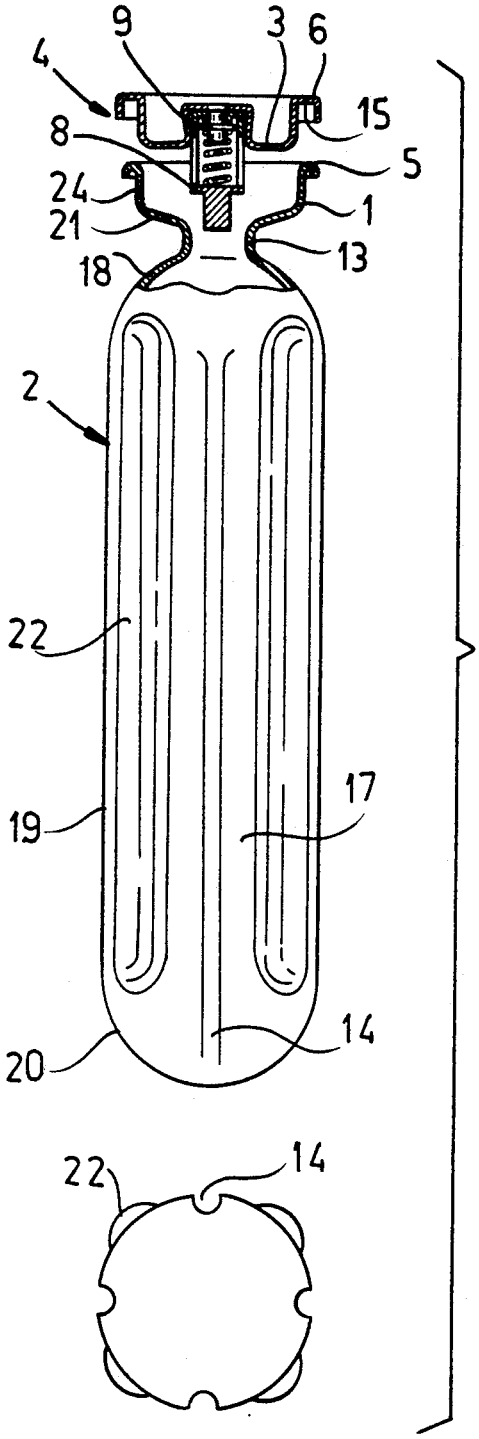
FIG. 1 is a side view and a view from the bottom of a liner, which is attachable to the mounting cup.

The valve/liner unit 4 shown in FIG. 1 consists of an aerosol valve with its mounting cup 3, a seat 9, a plastic housing 8, which is with its upper part crimped in the mounting cup 3 and in which the seat 9 is contained, and of a liner 2. FIG. 1 the liner 2 is not yet attached to the mounting cup 3 of the valve.

The liner 2 made of a flexible plastic material, preferrably polyethylene, is shaped in its basic form like a cylinder and its bottom 20 is convex and mates with body 19. Within the upper area of the body 19, a neck 13 is formed which is a continuation of the shoulder 18 of the body 19. At the upper end of the neck 13 the liner widens through a segment 21 and follows the diameter of the cylindrical shaped upper part 24 of the opening.

The body 19 of the liner 2 is equipped with grooves 14 which extend lengthwise from the shoulder to the bottom 20 of the liner, and also with a series of outward lengthwise bulges extending from the bottom to the shoulder 18.

The edge 6 of the mounting cup 3 is rounded over like an inverted trough. The underside 15 of the edge 6 of the mounting cup 3 corresponds in its shape to the form of the brim 5 of the liner 2. Between the apex of the brim 5 and the underside 15 of the trough shaped edge of the mounting cup 3, a ring gasket may be inserted which is not shown in the aforementioned figures.

In order to combine the liner 2 with the mounting cup 3 of the valve, and in order to manufacture an assembly, namely, a valve liner unit 4, the liner 2 is positioned in relation to the mounting cup 3 of the valve so that the brim 5 seats on the underside of the trough shaped edge of the mounting cup 3 of the valve, where eventually a ring gasket could be inserted. In this position, the liner 2 with the inside of the neck 13 comes near or in direct contact with the outside of the housing 8 of the valve. In the next step, the seat 9 of the housing 8 of the valve is pressed downward with a hollow filling needle 7; from outside, the housing 8 of the valve is connected with a vacuum so that the air is withdrawn from the interior 17 of the liner 2. During this step of evacuation, the opening 1 of the liner 2 is attached firmly to the underside 15 of the mounting cup 3 of the valve while brim 5 is especially pressed together with the cylindrical shaped upper part 24 of opening 1. Simultaneously, the inner surface of the neck 13 comes in firm contact with the outside of the housing 8 of the valve with the effect that the evacuated liner 2 is automatically oriented in a vertical position. Because of its design with four grooves 14 and four bulges 22 the liner 2 appears, after evacuation, in its bottom view, as shown in this example, at the foot of FIG. 2.

It is also possible to supply the liner 2 with only two grooves 14 which are diametrically opposite of each other, the result of which is a shape of the compessed liner 2, after being evacuated, that can be easily rolled inward.

By designing the liner 2 in other profiles, it is possible to obtain a variety of shapes of the liner 2 after evacuation.

After evacuation, i.e. after removing the air of the interior 17 of the liner 2, the hollow needle 7 is withdrawn. Under the tension of the spring beneath the seat 9 of the housing 8 the valve is automatically closed. The liner 2 with its opening 1 is secured, by the vacuum suction, to the under surface 15 of the mounting cup 3. Any unintended separation is unlikely because of the considerable force, which is needed to separate the liner from the valve.

Figure 2:
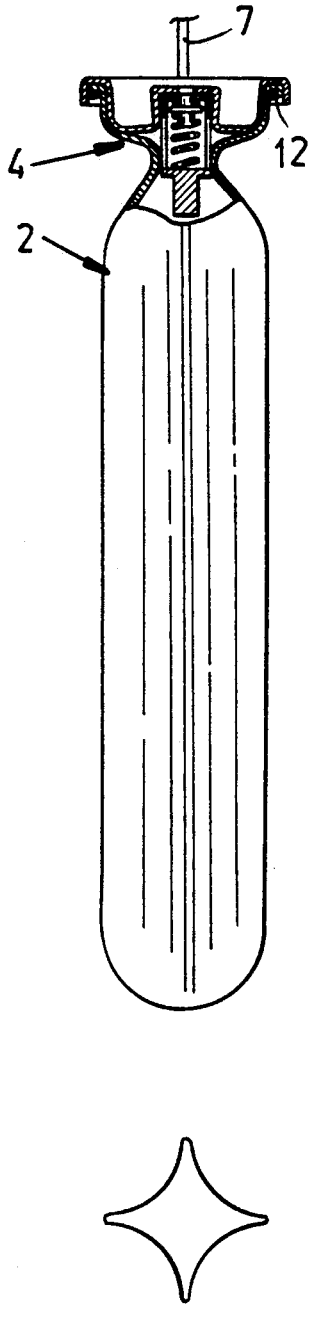
FIG. 2 is a unit consisting of a valve with its mounting cup, housing, inner elements, and a liner.

In this manner, the valve/liner unit 4 as shown in FIG. 2 is obtained by evacuation of the liner. This unit can be stored like a single part, transported, and handled farther on as well.

For combining the valve/liner unit with an aerosol container, it must be inserted through the opening 16 at the top of the cylindrical container 10 into its interior. The container 10 is equipped in the area of its opening 16 with a welt 11 made of the same material. This welt 11 is designed so that a tight fit is possible between the welt 11, the brim 6 of the liner, and the under surface of the trough shaped edge 6 of the mounting cup 3. In order to improve the gas tight fit of the assembly an "O" ring gasket 12 can be inserted in the grooved underside of the mounting cup of the valve.

Figure 3:
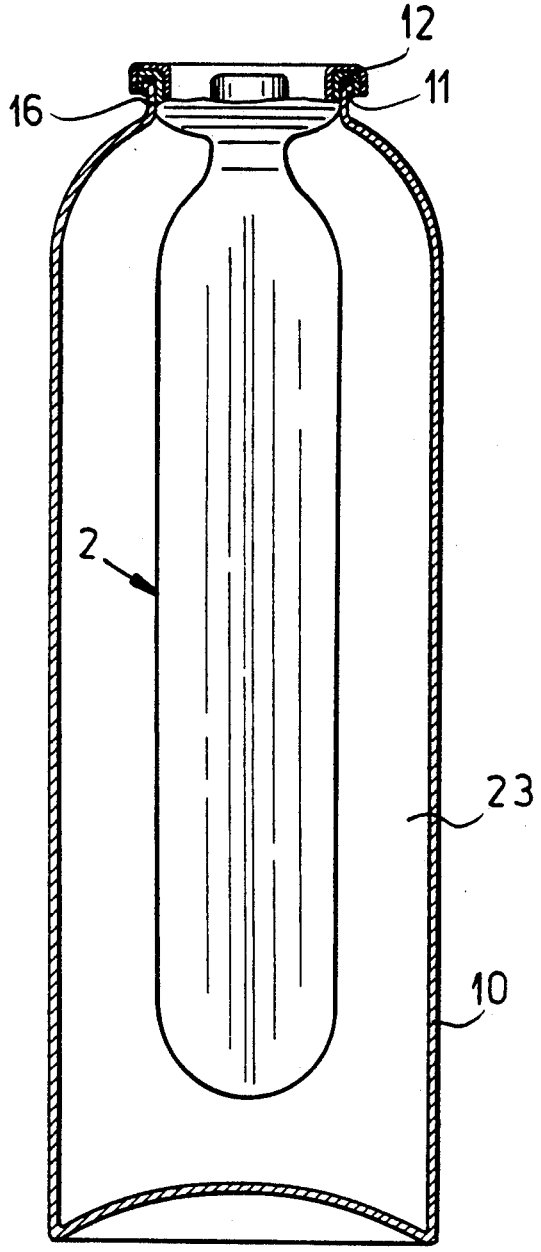
FIG. 3 is a valve/liner unit inserted in a pre-pressurized container.
Figure 4:
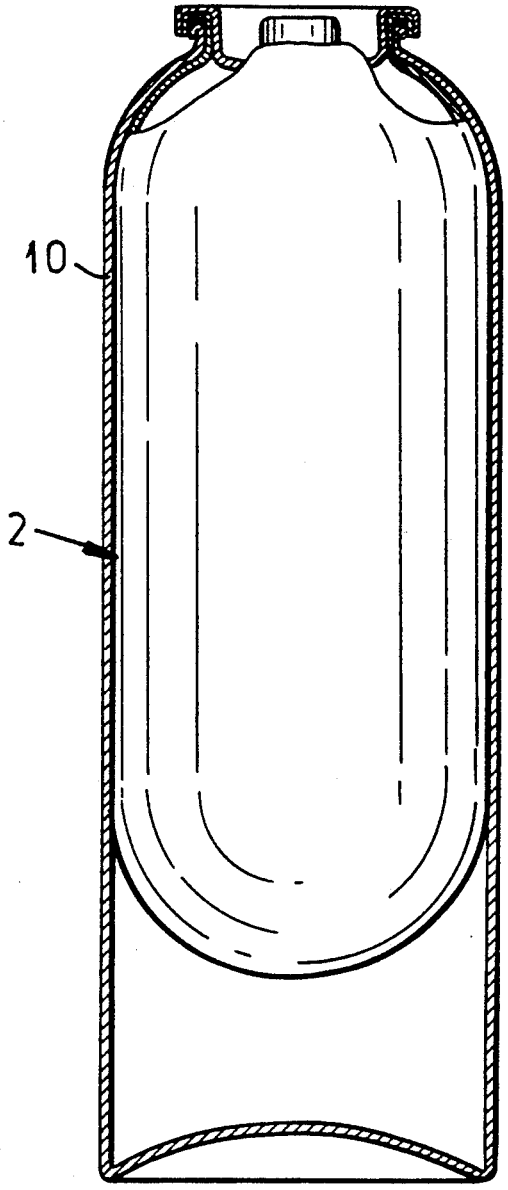
FIG. 4 is the valve/liner unit inserted in the pressurized container after the liner is filled.

After the insertion of the valve/liner unit 4 into the unpressurized container 10, the latter is pressurized with air. The valve liner unit 4, which is in a seated position as shown in FIG. 3, must for this reason be lifted slightly. By this step a small, consistently controlled space is created between the opening 1 of the liner 2 which is pneumatically secured to the underside 15 of the mounting cup 3 of the valve, and the welt 11 surrounding the opening 16 of the unpressurized container 10. Through this space, the interior 23 of the container 10 is pressurized. During the filling operation the valve/liner unit is kept in the elevated position magnetically, pneumatically, and/or mechanically. The pressurizing process is continued until the whole interior 23 which surrounds the evacuated liner 2 in the container 10 has reached the intended pressure. Immediately thereafter the valve/liner unit 4 is moved totally into the container 10. During this step the opening 1 of the liner 2 is combined with the mounting cup 3 so that the brim 5 makes positive, complete contact with the welt 11 of the container 10. After contact, the edge 6 of the mounting cup 3 is crimped to the welt 11 of the container 10. During the crimping operation the "O" ring gasket, in case applied, is positioned between the brim 5 and the welt 11 securing the tightness of the crimping.

After pressurizing of the container 10 with non-condensable propellant is accomplished under given pressure, which is easily obtained using an "Under the Cap" gasser equipment, the defined pressure is kept until the evacuated liner 2 is sealed by the crimping as mentioned above. Therefore, it is possible to pre-pressurize the interior 23 of the unpressurized container 10 with the intended pressure under controlled conditions. If the container afterward is filled with liquid or pasty goods under pressure and the liner is expanded by receiving same, the pressure of the original pre-pressurized container is accordingly increased until reaching the final intended pressure.

After crimping of the valve/liner unit 4 on the container 10 and after removing the head of the U-t-C gasser, by which the container has been pre-pressurized, the seat 9 of the housing 8 is opened during the insertion of the filling goods under pressure such as condensed gas, liquid, or paste, into the evacuated air free liner 2, which can be accomplished by all types of propellant pressure chargers. The originally compressed liner 2 is unfolded until it has regained its original shape. By continuing the process of filling with gaseous, liquid, or pasty filling goods, the liner 2 will be rapidly expanded exceeding the original shape of the liner 2.

During the filling process, the liner 2 is finally expanded to such an extent that its walls are completely aligned with the walls of the container.

I claim:

1. A method for assembling a valve-container unit, said unit comprising:

a container formed from a flexible plastic material comprising:

a liner with cylindrical walls having an open end and a closed end;

a cylindrical neck having a first and second end opposite one another, the first end being connected to the open end;

a cup-shaped upper area with walls of major diameter greater than the neck having an open mouth and an open rear end juxtaposed opposite each other, the rear end being directly connected to the second end of the neck; and a valve unit inserted into said cup-shaped upper area comprising:

a mounting cup formed of walls with upper and lower surfaces, said walls being raised to project upwardly in a central bottom area of said cup thereby forming on said lower surface a hollow well;

a valve housing inserted within said hollow well;

a valve seat positioned within said housing; and said method comprising:

(i) inserting said valve unit into said cup-shaped upper area;

(ii) opening said valve seat;

(iii) withdrawing air from said container to cause an upper surface of said walls of said cup-shaped upper area to securely sealingly become attached to said lower surface of said mounting cup.

2. A method according to claim 1 further comprising the steps of positioning said valve housing within said neck and supportingly contacting said housing as a result of withdrawing said air.

3. A method for assembling and filling a pressurizable vessel, said vessel comprising:

an outer rigid aerosol container;

a flexible plastic container positioned within said outer rigid aerosol container comprising:

a liner with cylindrical walls having an open end and a closed end;

a cylindrical neck having a first and second end opposite one another, the first end being connected to the open end;

a cup-shaped upper area with walls of major diameter greater than the neck having an open mouth and an open rear end juxtaposed opposite each other, the rear end being directly connected to the second end of the neck; and a valve unit inserted into said cup-shaped upper area comprising:

a mounting cup formed of walls with upper and lower surfaces, said walls being raised to project upwardly in a central bottom area of said cup thereby forming on said lower surface a hollow well;

a valve housing inserted within said hollow well;

a valve seat positioned within said housing; and said method comprising:

(i) inserting said valve unit into said cup-shaped upper area;

(ii) opening said valve seat;

(iii) withdrawing air from said container to cause an upper surface of said walls of said cup-shaped upper area to securely sealingly become attached to said lower surface of said mounting cup;

(iv) inserting said evacuated flexible plastic container and valve unit into an open end of said outer aerosol container;

(v) pressurizing with a gas said aerosol container in an area between an inner surface of walls defining said aerosol container and an outer surface of said liner walls; and (vi) crimping together said open end of the outer aerosol container with said mounting cup of said valve unit and said cup-shaped area of said evacuated flexible container.

4. A method according to claim 3 further comprising a step (vii) of filling said liner to such extent that said walls of said liner are expanded lengthwise to contact an inner surface of said aerosol outer container.

5. A method according to claim 3 further comprising a step (vii) of forcefully and rapidly filling said liner with product.

6. A method according to claim 3 comprising between steps (iv) and (v), the further step of lifting up said inserted flexible plastic container and valve unit to provide an opening between said open end of said outer aerosol container and said neck, thereby allowing space for introducing said pressurizing gas.

* * * * *

UNITED STATES PATENT AND TRADEMARK OFFICE

CERTIFICATE OF CORRECTION

PATENT NO. : 5,265,765

DATED : November 30, 1993

INVENTOR(S) : Hans Erich MAIER

It is certified that error appears in the above-indentified patent and that said Letters Patent is hereby corrected as shown below:

On the title page, item [22], change "Feb. 7, 1992" to --May 8, 1991--.

Below item [22] insert --

[86] PCT NO. PCT/EP91/00860
§ 371 Date: Feb. 7, 1992
§ 102 (e) date: Feb. 7, 1992

[87] PCT Pub. No.: WO 91/19653
PCT Pub. Date: Dec. 26, 1991

[30] Foreign Application Priority Data:
June 9, 1990 [DE] Germany .....
P 40 18 528 --

Signed and Sealed this

Tenth Day of May, 1994

Bruce Lehman

*Attest:*

BRUCE LEHMAN

*Attesting Officer*

*Commissioner of Patents and Trademarks*